United States Patent [19]

Ingeveld et al.

[11] Patent Number: 4,758,761

[45] Date of Patent: Jul. 19, 1988

[54] ELECTRIC LAMP VESSEL HAVING A MIRROR COATING WITH A SHARPLY DEFINED BOUNDARY

[75] Inventors: Johannes W. Ingeveld; Albert J. Westerhof, both of Weert, Netherlands

[73] Assignee: U.S. Philips Corporation, New York, N.Y.

[21] Appl. No.: 40,450

[22] Filed: Apr. 16, 1987

[30] Foreign Application Priority Data

Apr. 16, 1986 [NL] Netherlands ..... 8600955

[51] Int. Cl.[4] ..... H01K 1/32; H01J 5/10

[52] U.S. Cl. ..... 313/113

[58] Field of Search ..... 313/113

[56] References Cited

U.S. PATENT DOCUMENTS 2,115,839 5/1938 Briefer ..... 313/113

4,633,126 12/1986 Giller et al. ..... 313/113

*Primary Examiner*—Palmer C. DeMeo

*Attorney, Agent, or Firm*—Algy Tamoshunas; Brian J. Wieghaus

[57] ABSTRACT

The electric lamp has a lamp vessel of which a wall portion is mirror-coated at its inner surface with an aluminum layer. This wall portion has a boundary near the largest diameter of the lamp vessel. This boundary is adjoined by a thermally connected zone having a transparent aluminum oxide layer. In the lamp, a dark zone caused by a very thin aluminum layer adjoining the boundary is avoided.

3 Claims, 1 Drawing Sheet

ELECTRIC LAMP VESSEL HAVING A MIRROR COATING WITH A SHARPLY DEFINED BOUNDARY

BACKGROUND OF THE INVENTION

The invention relates to an electric lamp comprising a glass lamp vessel sealed in a vacuum-tight manner and having a largest diameter. The lamp vessel has a translucent wall portion and a wall portion which is mirror-coated on its inner surface with an aluminum layer, this mirror-coated wall portion having a boundary near the largest diameter of the lamp vessel. A light source is arranged in the lamp vessel and current-supply conductors extend through the wall of the lamp vessel to the light source. Such a lamp is known from European Patent Specification No. 0 022 304 corresponding to abandoned U.S. Application Ser. No. 161,952.

Lamps of the kind described in the aforementioned European Patent Specification are manufactured by evaporating aluminum in the lamp vessel at a reduced pressure. For this purpose, a filament carrying a piece of aluminum is temporarily arranged in the lamp vessel. By current passage through this filament the aluminum is heated and evaporated. Unless this source of aluminum vapour is screened in part, substantially the whole lamp vessel is mirror-coated with a layer of aluminum.

Wall portions that should remain without a mirror-coating, can have their aluminum layer removed with lye. A sharp transition can then be obtained between wall portions that are mirror-coated and wall portions that are not mirror-coated. However, disadvantages of this manufacturing method are that the lye has to be completely removed by carefully washing the lamp vessel, that the lamp vessel has to be dried thoroughly, that the lye and the washing water used have to be made harmless for the environment and that there is a risk of the reflective layer being damaged by spatters of lye or washing-water.

Because of these disadvantages of the partial removal of a reflective coating, it is very attractive to be able to apply a reflective layer only at the areas at which it is desirable. The wall portion not to be coated could be covered with a mask. In most cases, however, this requires a mask which is larger than an opening in the lamp vessel (its neck), through which this mask has to be introduced. It has been suggested to use foldable masks which are expanded within the lamp vessel, but such masks are complicated and expensive. They have a short life because they soon cannot be fully expanded or folded any longer due to the fact that aluminum is deposited on them.

A simple and suitable method of partly mirror-coating a lamp vessel consists in that a screen is provided close to the vapour source, as a result of which a part of the wall of the lamp vessel lies in the shadow of this screen during evaporation of the aluminum. However, this method has the disadvantage that a part of the wall of the lamp vessel lies in a half-shadow. The lamp manufactured by this method has the disadvantage that a very thin aluminum layer has formed on the wall of the lamp vessel during evaporation at the area of the half-shadow. This very thin translucent aluminum layer manifests itself as a black zone which adjoins the mirror-coated wall portion near the largest diameter of the lamp vessel where the screen should have prevented deposition of aluminum.

The said half-shadow is caused by the fact that the vapor source is not infinitely small, but has a certain minimum volume when viewed by the surface to be covered. The half-shadow is also caused by the fact that aluminum vapor is exposed to the scattering effect of the residual gas in the lamp vessel on its way from the vapor source to the wall of the lamp vessel. The mirror-coating step is effected at reduced pressure, for example at 0.1 to 0.01 Pa, because an unacceptably long processing period would be involved in producing a high vacuum.

The dark zone limiting the mirror-coated wall portion in the known lamp is disadvantageous. The zone causes the lamp to have a poor aesthetic appearance and has an adverse effect on its appearance of quality. The zone does not reflect incident light from the light source efficiently, but does not transmit that light substantially completely either.

SUMMARY OF THE INVENTION

The invention has for its object to provide a lamp of the kind described, which can be readily manufactured and in which nevertheless the effect of the said half-shadow is counteracted.

According to the invention, this object is achieved in an electric lamp of the kind mentioned in the opening paragraph in that the inner surface of the lamp vessel has a zone which is coated with a transparent aluminum oxide layer and adjoins the boundary of the mirror-coated wall portion near the largest diameter of the lamp vessel.

It has surprisingly proved to be possible to remove the dark zone limiting a mirror-coated wall portion which is obtained by evaporation of aluminum with the use of a screen near the vapor source. This dark zone can be removed very rapidly while achieving a very sharp and straight boundary of the mirror-coated wall portion. When the dark zone is heated in air for a short time, a conversion of aluminum into aluminum oxide is obtained, which adjoins the mirror-coated wall portion as a barely visible whitish haze. Further, a part of the aluminum evaporates.

The heat treatment may be carried out by means of a burner having a sharply defined flame, but may alternatively be carried out by means of a laser, for example, a neodymium-doped yttrium-aluminum-garnet laser. The lamp vessel may be rotated about an axis at right angles to the boundary of the mirror-coated wall portion along the front of the heat source. A lamp vessel can thus be treated in a very short time, for example 1 second. The use of such a laser has the additional advantage that its heat is substantially not absorbed by the glass of the lamp vessel. Thus, stresses are prevented from being produced in the glass. If the heat source, for example a burner, heats the glass of the lamp vessel above its lowest transition temperature, i.e. in the case of lamp glass about 495° C., it is recommendable to eliminate stresses in the glass by gradually cooling the glass. In general, however, stresses can be prevented from being built up in the glass by keeping the temperature just below the lowest transition temperature.

Upon accurate observation, the zone with the aluminium oxide layer is visible on a transparent wall portion as a whitish haze. The latter does not adversely affect the appearance of the lamp. However, the aluminium oxide layer can be clearly observed by means of Auger Electron Spectroscopy (AES).

The zone with the aluminium oxide layer (Z) was examined by means of AES (t=0) with respect to the presence of Al, O and Si. After the measurement, the zone was sputtered with $Ar^+$ ions for 1 minute and measured again (t=1). A third measurement was carried out after sputtering for about 1 minute (t=2). The same examination was carried out on the mirror-coated wall portion (M) and on the wall of another lamp vessel at the area at which an aluminum layer was removed by etching with lye (E). The results are indicated in Table 1.

TABLE 1

| t (min) | | 0 (at %) | Al (at %) | Si (at %) |
|---|---|---|---|---|
| 0 | Z | 57 | 43 | n.d. |
| | M | 65 | 35 | n.d. |
| | E | 65 | 2 | 33 |
| 1 | Z | 58 | 36 | 6 |
| | M | 2 | 98 | n.d. |
| | E | 65 | 1 | 34 |
| 2 | Z | 58 | 24 | 18 |
| | M | 1 | 99 | n.d. |
| | E | 65 | n.d. | 35 |

n.d. = not detectable

The Table shows that the mirror (M) consists at its surface (t=0) of aluminum oxide and at areas located more deeply (t=1; 2) of aluminum metal. A wall portion which is freed from an aluminum layer by etching (E) has at its surface (t=0) a very small quantity (2 at.%) of aluminum in oxidic form; below this surface this quantity is halved (t=1) and is not detectable (t=2), respectively. The zone of the lamp according to the invention (Z) on the contrary consists at the surface (t=0) completely of aluminum oxide (no silicon is found). Below the surface the content of silicon increases (t=1; 2). Also at this area the aluminum present is in the oxidic form, as was also apparent from the signal of a spectrometer.

The film of aluminum oxide, which is at the surface substantially free from silicon, is characteristic of the zone in the lamp according to the invention. In contrast, a glass surface freed from the reflective aluminum layer by etching has only very small residues of oxidic aluminum.

The electric lamp according to the invention may have as a light source a filament or a pair of electrodes in an ionizable gas.

The mirror-coated wall portion may have different shapes, such as the shape of a ring in the case of a reflector lamp and substantially the shape of a hemisphere in the case of a bowl mirror lamp.

BRIEF DESCRIPTION OF THE DRAWINGS

Embodiments of the lamp according to the invention are shown in the drawing. The drawings show, partly in section.

PREFERRED EMBODIMENT OF THE INVENTION

Figure 1:
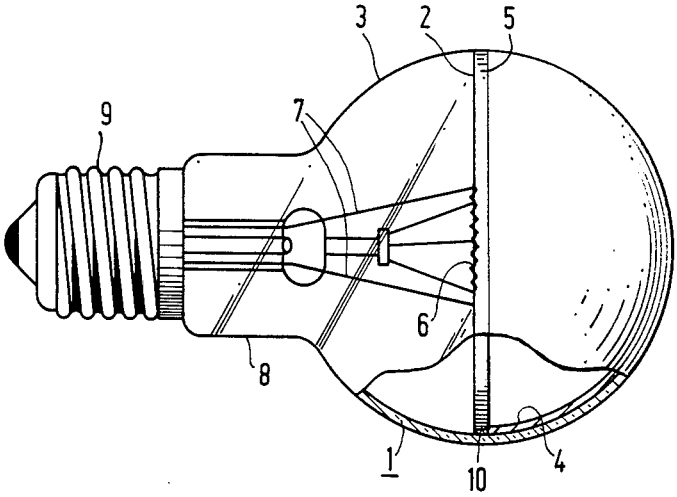
in FIG. 1 a bowl mirror lamp in side view, and in FIG. 2 a ring mirror lamp in side view.

In FIG. 1, the bowl mirror lamp comprises a blown glass lamp vessel 1 sealed in a vacuum-tight manner and having a largest diameter 2, a transparent wall portion 3 and a wall portion 4 which is mirror-coated on its inner surface with an aluminum layer and has a boundary 5 near the largest diameter 2 of the lamp vessel 1. A filament 6 is arranged as a light source in the lamp vessel 1 and current supply conductors 7 extend through the wall of the lamp vessel 1 to this filament 6. The lamp vessel has a neck-shaped wall portion 8 at the area at which the lamp vessel 1 is sealed, this wall portion carrying a lamp cap 9. The inner surface of the lamp vessel 1 has a thermally converted zone 10 which is a transparent aluminum oxide layer and which adjoins the boundary 5 of the mirror-coated wall portion 4 near the largest diameter 2 of the lamp vessel 1.

Figure 2:
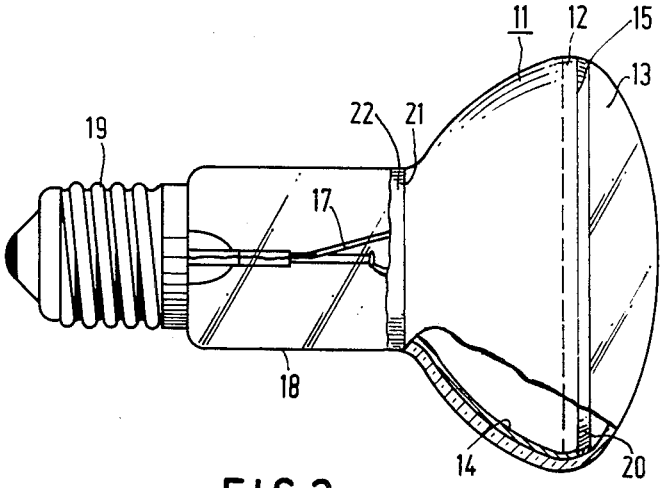

In FIG. 2, corresponding parts are designated by a reference numeral which is 10 higher than in FIG. 1. In this Figure, the mirror-coated wall portion 14 is annular and has a second boundary 21 located in the neck-shaped wall portion 18. This boundary 21 is adjoined by a zone 22 which has an aluminum layer of only small thickness, as a result of which it has a dark appearance. The zone 22 is of little importance because a reflective layer in this zone is of no importance for the concentration of light and because in this zone no useful light could emanate either in case the coating were absent. Furthermore, this zone is not disturbing because the part of the lamp in which this zone is located is generally situated during operation within a luminaire or lamp holder.

In contrast to the transparent wall portion 13, which has a diameter larger than that of the neck-shaped wall portion 18, the zone 22 and the remaining part of the neck-shaped wall portion 18 facing the lamp cap 19 can readily be screened by a mask from the vapor source during the application of the aluminum layer. During the application of the aluminum layer, the neck-shaped wall portion 18 then does not yet exhibit a narrowed part near the lamp cap 19, as shown in the Figure, but is widened at this area so that, if desired, a mask of the desired size may readily be introduced.

If desired, however, the zone 22 may also be thermally converted into a zone with a transparent aluminum oxide layer.

The bowl mirror lamp of FIG. 1 may also have an annular mirror-coated wall portion if a light window is present opposite to the lamp cap 9. A similar zone with a transparent aluminum coating may be present at the boundary between th mirror-coated wall portion and this window.

What is claimed is:

1. An electric lamp comprising:

a blown glass lamp vessel sealed in a vacuum tight manner and having a largest diameter, a transparent wall portion and a wall portion mirror-coated at its inner surface with an aluminum layer, this mirror-coated portion having a boundary near the largest diameter of the lamp vessel;

a light source arranged in the lamp vessel; and current supply conductors extending through the wall of the lamp vessel to the light source; characterized in that the inner surface of the lamp vessel has a zone which is coated with a transparent aluminum oxide layer and which adjoins the boundary of the mirror-coated wall portion near the largest diameter of the lamp vessel.

2. An electric lamp as claimed in claim 1, characterized in that the mirror-coated wall portion is annular and has a second boundary.

3. An electric lamp as claimed in claim 2, characterized in that the second boundary is also adjoined by a zone coated with a transparent aluminum oxide layer.

* * * * *